United States Patent [19]

Jardat et al.

[11] Patent Number: 4,501,182

[45] Date of Patent: Feb. 26, 1985

[54] APPARATUS FOR CUTTING BY MEANS OF A HIGH PRESSURE FLUID JET

[75] Inventors: Alain Jardat, Courbevoie; Joël André, Bougival, both of France

[73] Assignee: Societe Nationale Industrielle Aerospatiale, Paris, France

[21] Appl. No.: 541,137

[22] Filed: Oct. 12, 1983

[30] Foreign Application Priority Data

Oct. 19, 1982 [FR] France ..... 82 17473

[51] Int. Cl.[3] ..... B26F 1/26; B26F 1/30; D06H 7/00

[52] U.S. Cl. ..... 83/177; 83/925 CC

[58] Field of Search ..... 83/53, 177, 925 CC

[56] References Cited

U.S. PATENT DOCUMENTS

| | | | |
|---|---|---|---|
| 3,877,334 | 4/1975 | Gerber | 83/22 |
| 4,092,889 | 6/1978 | Fisher | 83/177 |
| 4,137,804 | 2/1979 | Gerber et al. | 83/177 |
| 4,312,254 | 1/1982 | Pearl | 83/925 CC |

FOREIGN PATENT DOCUMENTS

| | | |
|---|---|---|
| 1460125 | 11/1968 | Fed. Rep. of Germany . |
| 1443508 | 5/1966 | France . |
| 567908 | 10/1975 | France . |
| 2405116 | 4/1979 | France . |

*Primary Examiner*—James M. Meister

*Attorney, Agent, or Firm*—Pearne, Gordon, Sessions, McCoy, Granger & Tilberry

[57] ABSTRACT

Apparatus for cutting by a high pressure fluid jet comprising a working nozzle supplying a fluid jet, a worktable able to support a material to be cut, a mechanism for displacing the working nozzle in a given cutting direction and a jet recovery system, wherein the worktable has a slot facing the working nozzle in the cutting direction, the jet recovery system being positioned behind said slot and having a chute at the bottom in which circulates a relatively cold liquid, an alveolar material placed at the inlet to the chute and set back relative to the worktable, and a vacuum is provided at the inlet to the chute, between the worktable and the alveolar material. Application to the cutting of materials in sheet form, as well as composite materials.

9 Claims, 4 Drawing Figures

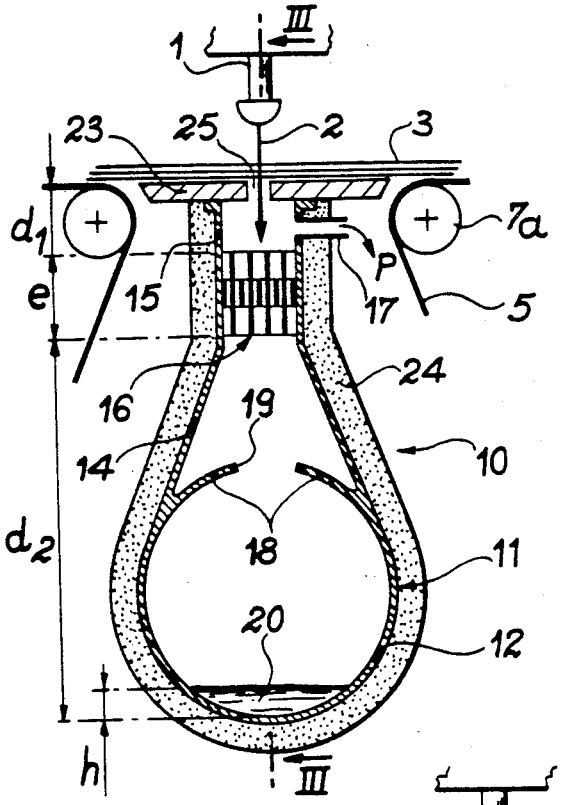
FIG. 2
FIG. 3
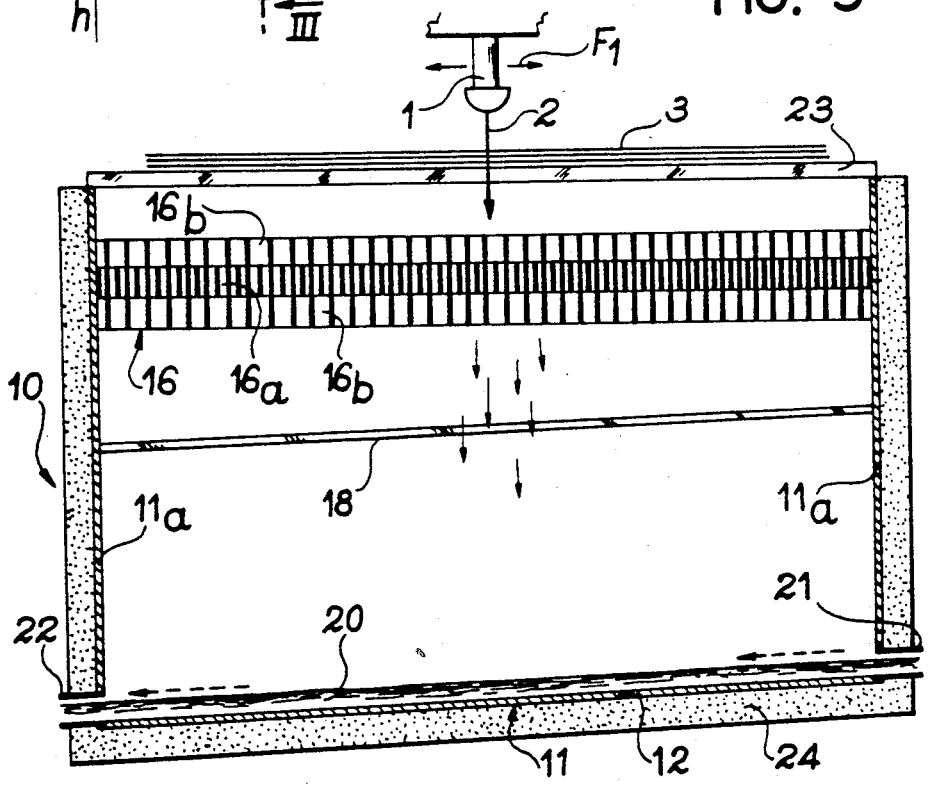

APPARATUS FOR CUTTING BY MEANS OF A HIGH PRESSURE FLUID JET

BACKGROUND OF THE INVENTION

The present invention relates to an apparatus for cutting by means of a high pressure fluid jet intended for cutting sheet-like materials, such as plastics, paper, leather, rubber, etc. and composite materials in the form of layers of fibres and more particularly synthetic fibres, such as glass, carbon or aromatic polyamide fibres, and these layers can be preimpregnated and possibly laminated.

In the case of such apparatuses, a high pressure fluid jet, concentrated by a nozzle, cuts materials placed on a work table, the fluids used generally being running water. This fluid jet moves along its axis at supersonic speed at the nozzle outlet and above the members to be cut, the cutting speed being variable as a function of the materials, but can be very high. In such apparatus, the fluid jet contains a considerable residual energy on leaving the material which it has just cut. It is therefore necessary to provide a jet recovery system facing the nozzle.

Various fluid jet cutting apparatuses incorporating a jet recovery system are known.

Thus, French Pat. No. 2 405 116 describes a fluid jet cutting apparatus, which comprises a cutting table constituted by a rectangular tank, in which is mounted a bench or frame formed by a honeycomb structure and the material to be cut entirely rests thereon. The upper edges of the walls of the relatively small cells formed by the honeycomb structure are in the form of notches or scallops and have points located at the intersections of the walls of the cells and on which rests the material to be cut. Below the honeycomb structure are fixed parallel deflecting plates arranged in such a way that they are inclined downwards and their upper edges are in the form of a knife blade and located between two walls of cells of the honeycomb structure.

In this known apparatus, the recovery of the residual energy of the fluid jets takes place both by means of the points, the notches or the scallops of the honeycomb structure, which split up or fuse the jet, and by means of the relatively small cells of this structure which confine the jet. Moreover, a protective sheet made from a plastic or similar material is positioned between the material to be cut and the top of the table. This sheet, which is cut during the passage of the jet, makes it possible to prevent splashes.

According to a constructional variant of the cutting apparatus described in French Pat. No. 2 405 116, the bench or frame located in the rectangular tank no longer contains a honeycomb structure. Instead it contains a series of plates, whose upper edges are shaped like a knife blade and said plates are curved downwards and shatter the residual jet. In the upper part of the rectangular tank is placed a material such as metal wool, steel shot or grit, which serves to reduce splashes, reduce noise and prevent excessive wear to the plates. In order to absorb the residual energy, the bench contains a liquid which can be kept at a constant level.

French Pat. No. 2 405 117 describes a fluid jet cutting apparatus of the same type as in the preceding patent and applied to the cutting of a pile of flexible sheets. This apparatus comprises a cutting table formed by a basic container containing vertical elongated elements which terminate in a tip or point and on which rests the pile of sheets. A vacuum device is placed on the cutting table and applied to the periphery of the pile in such a way as to compress the latter in the vertical direction under the effect of the thus produced vacuum. The pile of flexible sheets then offers the characteristics of a rigid mass, which can be very effectively cut. In this apparatus, the residual energy is recovered by means of elongated, pointed elements and by the pressurization of the bottom of the bench or frame. As in the case of the previously described apparatus, splashes are obviated by the arrangement of polyethylene sheets between the sheets to be cut and the top of the table.

In a constructional variant of the apparatus described in French Pat. No. 2 405 117, at the bottom of the elongated, pointed elements is arranged a mass of tangled metal wires, which serve to absorb the energy. This absorption can be increased by filling the bench with a liquid in which said metal mass is immersed.

The jet recovery systems used in these fluid jet cutting apparatuses according to the prior art suffer from a certain number of disadvantages.

Thus, in these cutting apparatuses, the honeycomb structure or the like constitutes the support for the material to be cut. It is therefore necessary to have a large quantity of said structure. Moreover, the structure must be machined at least at the level of the upper edge and must frequently be replaced, because it deteriorates when used. Thus, these known apparatuses suffer from a high price and high maintenance costs.

In addition, due to the fact that the material to be cut rests directly on the honeycomb structure, serious splashes occur and protection must be obtained against these by arranging intermediate sheets between the material to be cut and the structure. These jet splashes lead to a serious wetting of the material so that its mechanical and physical properties may deteriorate.

Finally, the vacuum device used in the apparatus described in French Pat. No. 2 405 117 in order to greatly compress the stack of sheets to be cut suffers from the major disadvantage of causing serious wetting between these different stacked sheets, due to the suction of cutting water through the stack.

SUMMARY OF THE INVENTION

The object of the present invention is a fluid jet cutting apparatus comprising a jet recovery system not suffering from the disadvantages of the known recovery systems and making it more particularly possible to reduce the price and maintenance costs of said apparatus, whilst causing no significant wetting of the material to be cut, which more particularly makes it possible not to reduce the physical and mechanical properties thereof.

Thus, the present invention relates to an apparatus for cutting by means of a high pressure fluid jet comprising a working nozzle supplying a fluid jet, a work table able to support a material to be cut, means for displacing the working nozzle in a given cutting direction and a jet recovery system, wherein the work table has a slot facing the working nozzle in the cutting direction, the jet recovery system being positioned behind said slot and having a chute at the bottom in which circulates a relatively cold liquid, an alveolar material placed at the inlet to the chute and set back relative to the work table, and means for producing a vacuum at the inlet to the chute, between the work table and the alveolar material.

Preferably, deflectors are positioned between the bottom of the chute and the alveolar material and define between them a slot permitting the passage of the fluid jet, the assembly formed by the bottom of the chute and the deflectors having an approximately circular cross-section outside said slot, so as to produce a liquid circulation during the impact of the fluid jet, whilst preventing the liquid from rising towards the alveolar material.

In order to reduce the apparatus noise, there is preferably a layer of soundproofing material around the chute.

In order to permit the circulation of the liquid in the bottom of the chute without supplying external energy, the bottom of said chute is preferably inclined slightly in the cutting direction.

The width of the slot formed in the worktable, as well as the diameter of the nozzle used for carrying out the cutting can be modified as a function of the thickness and nature of the material to be cut. Preference is given to the use of regulatable means for the purpose of establishing the vacuum at the inlet to the chute.

For cutting materials into sheets by means of a wire saw, it is more particularly known from French Pat. No. 1 443 508 to use a worktable constituted by part of a flexible endless belt forming a loop level with the cutting zone. According to the invention, such a structure can advantageously be used, the jet recovery system then being located in the loop-like part of the flexible belt. As a result of the addition of this feature it is possible, by a combination of the movements of the apparatus to bring about cutting along a random line, the slot of the chute being permanently positioned in front of the nozzle.

BRIEF DESCRIPTION OF THE DRAWINGS

The invention is described in greater detail hereinafter relative to non-limitative embodiments and with reference to the attached drawings, wherein show:

FIG. 2 a larger scale sectional view showing the working nozzle and the jet recovery system of the apparatus of FIG. 1.

FIG. 3 a cross-sectional view along line III—III of FIG. 2.

DETAILED DESCRIPTION OF THE INVENTION

Figure 1:
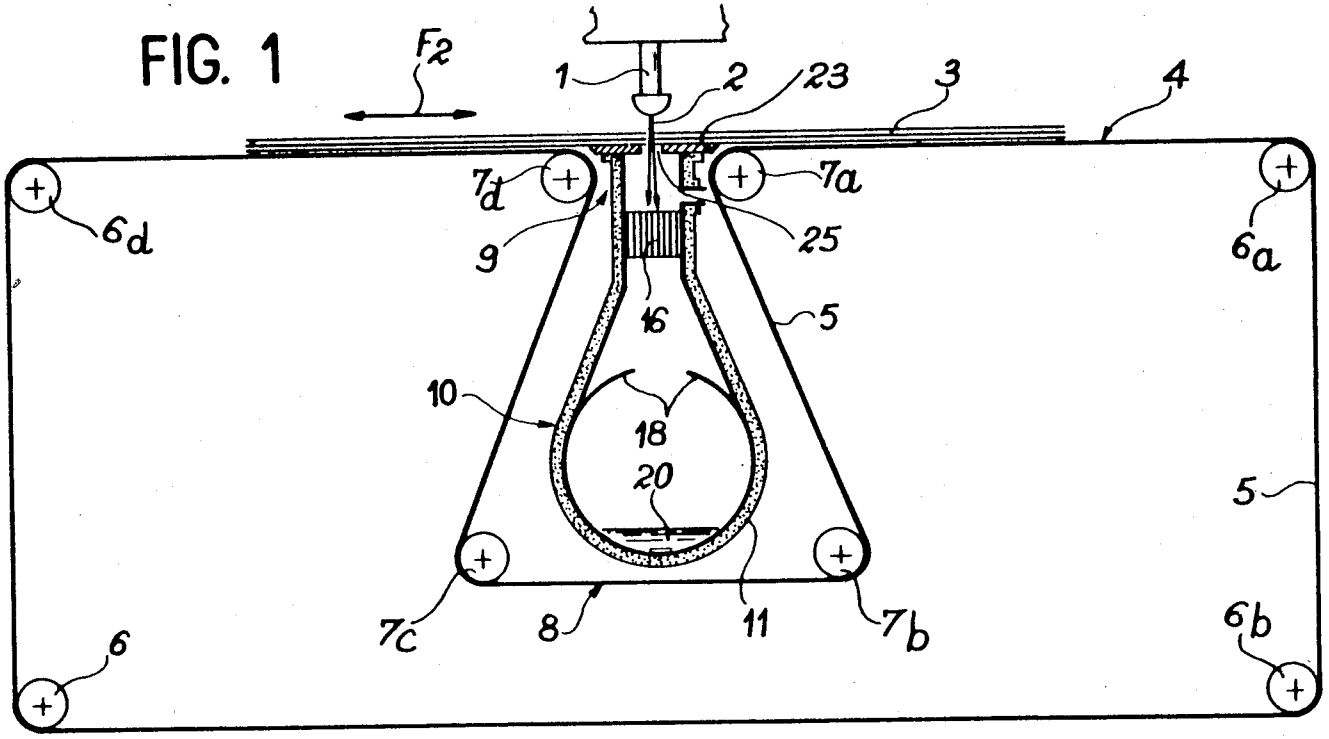
FIG. 1 a diagrammatic sectional view in elevation of a fluid jet cutting apparatus according to the invention.

FIG. 1 diagrammatically shows an automatic fluid jet cutting apparatus comprising a working nozzle 1 supplying a jet 2 of a fluid such as running water under a working pressure between e.g. 3000 and 4000 bars.

Jet 2 permits the high speed cutting of a sheet-like material 3 arranged on a worktable or surface 4, constituted by two planar portions and located in the same plane of a flexible endless belt 5 mounted on rollers 6*a* to 6*d* and 7*a* to 7*d*. More specifically, the two planar portions of the flexible belt 5 constituting the work surface 4 are formed by the part of said belt located on the one hand between rollers 6*a*, 7*a* and on the other between rollers 6*d*, 7*d*. As shown in FIG. 1, rollers 7*a* to 7*d* are disposed in such a way that the flexible belt 5 forms a loop 8 facing the working nozzle 1, said loop 8 connecting the two planar portions of the belt forming the work surface 4 by defining between these two planar portions and in front of nozzle 1 an opening 9.

A not shown mechanism of a random known type makes it possible to move nozzle 1 in a transverse cutting direction with respect to the apparatus, along opening 9. This displacement of the nozzle is illustrated by arrow $F_1$ in FIG. 3. At least one of the rollers 6, 7 carrying the flexible belt 5 is provided with known, not shown drive means. The construction of these means makes it possible to advance belt 5 (arrow $F_2$) in FIG. 1 and the material 3 supported thereon in a longitudinal direction relative to the apparatus, i.e. perpendicular to the cutting direction. In a constructional variant, the forward movement indicated by arrow $F_2$ is carried out by the assembly constituted by nozzle 1, the recovery system and the rollers 7, which are closely interlinked, with respect to the then fixed flexible belt 5 and retaining the preceding configuration, the nozzle separately retaining its forward movement $F_1$. In the two systems, a careful combination of movements $F_1$ and $F_2$ makes it possible to cut material 3 in a random, predetermined cutting line.

According to the invention, a jet recovery system 10 is located in loop 8. Bearing in mind the width of opening 9, which it is necessary to provide between the two planar portions of the flexible belt 5 constituting the work surface 4, in order to house the jet recovery system the work surface also has, in opening 9, and above the neck of the chute, two planar, fixed plates 23 forming between them a slot 25, whose width is adapted according to the thickness of the material to be cut, so as to permit the passage of jet 2.

The jet recovery system 10 mainly comprises a metal chute 11, which extends transversely over the entire width of the apparatus between two end partitions 11*a* and as shown in FIG. 3. FIG. 2 more particularly shows that the bottom of chute 11 defines a channel 12, having a circular arc-like cross-section. Just below the worktable 4, chute 11 has a neck 15 with a reduced width compared with the bottom 12 of the chute and to which are fixed plates 23. Neck 15 is connected to bottom 12 by a divergent portion 14.

Figure 4:
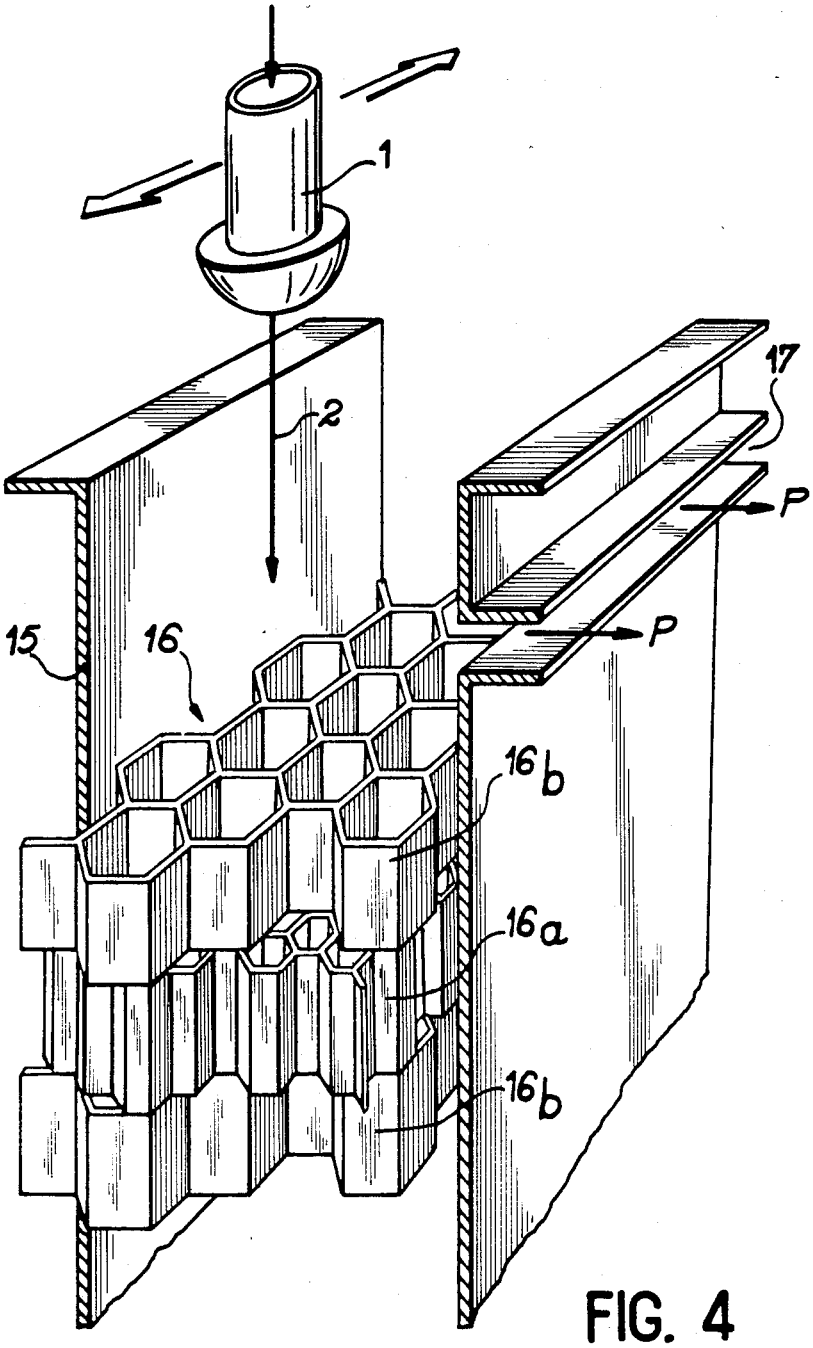
FIG. 4 a partial perspective view of the working nozzle and the upper part of the jet recovery system according to the invention.

The upper part of neck 15 of the chute is empty over a certain distance $d_1$ starting from the material 3 to be cut. After traversing distance $d_1$, the high pressure fluid jet encounters a layer 16, of thickness e, of a metallic alveolar material placed in the lower part of the chute neck 15. As is shown in FIGS. 2 to 4, the axis of the cavities formed in the material 16 is parallel to the axis of jet 2. Moreover, it is more particularly possible to see in FIGS. 2 and 3 that material 16 is constituted by a fine mesh structure 16*a*, sandwiched between two larger mesh structures 16*b*. Bearing in mind the pressure of the conventionally used fluid jets, the latter do not cut metals, so that the energy of the jet is dissipated on the webs or walls of the alveolar material.

During the absorption of the mechanical energy of the jet by the alveolar material 16, splashes occur in the upper part of the chute neck 15. In the same part, moisture is also produced due to the thermal dissipation action. Moreover, during its displacement, the jet entrains a large quantity of air, which could disturb the system. According to the invention, the splashes, moisture and air are eliminated by a vacuum device P in FIG. 2, which acts over the entire width of the apparatus by orifices or a slot 17 made in the wall of neck 15, between the cut material 3 and the alveolar material 16.

Preferably, the vacuum device acting through slot 17 can be regulated in order to adjust the vacuum at the entrance to the chute neck as a function of the material to be cut and as a function of the diameter of the nozzles used for carrying out the cutting operation. The regulation of the vacuum device communicating with orifice 17 more particularly makes it possible to increase the vacuum, when the material to be cut is flexible. Thus, slot 25 can be obstructed by this material, which limits the wetting of the top of the work surface. In the same way, in the case where the material to be cut is constituted by a pile or stack of sheets, the vacuum has the effect of lightly engaging the first sheet with the work surface level with the slot. Thus, the material to be cut is only slightly affected by the cutting moisture.

Following this first energy absorption element, the jet passes over a relatively large distance $d_2$ (FIG. 2) compared with distance $d_1$ before encountering a liquid, such as relatively cold running water 20 circulating in the bottom 12 of the chute. In the represented embodiment, the circulation of water 20 in the bottom of the chute takes place between an inlet 21 and an outlet 22, under the effect of a slight slope of base 12 (FIG. 3). This slope is slight, as is the flow rate of the water 12 resulting therefrom, so that the height h of the water in the bottom of the chute is suffient over the entire width of the apparatus to ensure an effective recovery of the energy of the jet at all points.

Between base 12 and divergent part 14, the inner wall of the chute is provided with two deflectors 18 having a circular arc-like cross-section extending the wall of the base 12 of the chute. The deflectors 18 face one another and are symmetrical with respect to the cutting plane produced by the axis of nozzle 1, when the latter moves transversely to the apparatus under the action of not shown, known control means. Between them, the ends of deflectors 18 define a slot 19, whose width is just adequate to permit the passage of the residual jet leaving the alveolar material 16.

Bearing in mind the virtually circular cross-section of the assembly constituted by the bottom of the chute 12 and the deflectors 18 outside slot 19, water 20 is put into a circular movement in the space formed in this way in the bottom of the chute during the impact of jet 2. Thus, the jet is shattered on the rotated water. The shape of the bottom of the chute and the deflectors makes it possible to prevent liquid from rising up and which could impair the quality of the cut material, particularly when it is composite material. It also makes it possible to prevent vibrations of the chute, which could occur during the energy absorption of the jet, as a result of its constructional symmetry. Finally, the circulation of water in the bottom of the chute makes it possible to remove the thermal dissipation energy of the jet.

As a result of the construction of the jet recovery system described hereinbefore, it is clear that the cutting apparatus according to the invention makes it possible to absorb the mechanical energy of the jet, dissipate the thermal energy resulting from this absorption and prevent liquid from rising up or splashes, which could deteriorate the quality of the cut material.

A significant amount of noise is produced during the successive absorptions of the residual energy of the jet. This noise is reduced to an acceptable level for persons present by means of the vacuum produced in the upper part of neck 15 through orifice 17, through the thickness e of alveolar materials 16 and due to the height h of the water in the bottom of the chute. Moreover, a layer 24 of a soundproofing material, such as a plastic material, can be placed on the outer wall of the chute.

Apart from the advantages of cutting apparatus according to the invention, which have been mentioned during the description, it should also be noted that the energy recovery system 10 is perfectly adapted to the recovery of a jet, which is never symmetrical due to the dispersion undergone by it under the effect of the cutting movement which, as has been stated, takes place in a plane parallel to the nozzle displacement direction and perpendicular to the part to be cut. Moreover, the construction of the apparatus according to the invention is such that it is easily possible to replace the first layer **16*b* of alveolar material, when this has become damaged. However, it should be noted that such a deterioration only occurs after a large number of cutting hours, due to the distance $d_1$ separating the alveolar material from the material to be cut. Moreover, the absence of machining of the alveolar material ensures that the replacement costs are modest. Finally, when the jet 2** from the nozzle is a water jet, the apparatus according to the invention makes it possible to recover the water used for the cutting, which can then be reinjected into the circuit of the apparatus after filtering.

What is claimed is:

1. An apparatus for cutting by means of a high pressure fluid jet comprising a working nozzle supplying a fluid jet, a worktable able to support a material to be cut, means for displacing the working nozzle in a given cutting direction and a jet recovery system, wherein the worktable has a slot facing the working nozzle in the cutting direction, the jet recovery system being positioned behind said slot and having a chute at the bottom in which circulates a relatively cold liquid, an alveolar material placed at the inlet to the chute and set back relative to the worktable, and means for producing a vacuum at the inlet to the chute, between the worktable and the alveolar material.

2. A cutting apparatus according to claim 1, wherein deflectors are positioned between the bottom of the chute and the alveolar material and define between them a slot permitting the passage of the fluid jet, the assembly formed by the bottom of the chute and the deflectors having an approximately circular cross-section outside said slot, so as to produce a liquid circulation during the impact of the fluid jet, whilst preventing the liquid from rising towards the alveolar material.

3. An apparatus according to claim 1, wherein the chute is surrounded by a layer of soundproofing material.

4. An apparatus according to claim 1, wherein the bottom of the chute slopes slightly in the cutting direction, in order to ensure a circulation of the liquid.

5. An apparatus according to claim 1, wherein the means for establishing the vacuum can be regulated.

6. An apparatus according to claim 1, wherein it comprises a flexible endless belt mounted on rollers, so as to form two planar portions disposed in the same plane and connected by a loop-like part, said planar portion defining the worktable, whilst the jet recovery system is located in the loop-like part.

7. An apparatus according to claim 6, wherein at least one of the rollers is associated with drive means making it possible to displace the belt in the forward direction of the material to be cut and orthogonal to the cutting direction.

8. An apparatus according to claim 6, wherein the recovery system and rollers are intimately connected and form an assembly moving in a forward direction orthogonal to the cutting direction, relative to the flexible fixed belt supporting the material to be cut.

9. An apparatus according to claim 1, wherein the slot in the jet recovery system permanently faces the nozzle, no matter what the relative movements of the different components of the apparatus.

* * * * *